United States Patent [19]

Young et al.

[11] Patent Number: 4,488,130

[45] Date of Patent: Dec. 11, 1984

[54] MICROWAVE INTEGRATED CIRCUIT, BANDPASS FILTER

[75] Inventors: Frederick A. Young, Huntington Beach; Robert J. Ahulii, Hawthorne; Roy K. Rikimaru, Los Angeles, all of Calif.

[73] Assignee: Hughes Aircraft Company, El Segundo, Calif.

[21] Appl. No.: 469,498

[22] Filed: Feb. 24, 1983

[51] Int. Cl.[3] ..... H01P 1/205; H01P 1/203

[52] U.S. Cl. ..... 333/203; 333/202; 333/204; 333/246

[58] Field of Search ..... 333/202–212, 333/219–223, 235, 245, 246

[56] References Cited

U.S. PATENT DOCUMENTS

| | | | |
|---|---|---|---|
| 2,749,523 | 6/1956 | Dishal | 333/212 |
| 3,959,749 | 5/1976 | Ikushima et al. | 333/203 |
| 4,418,324 | 11/1983 | Higgins | 333/204 |
| 4,423,396 | 12/1983 | Makimoto et al. | 333/204 |

*Primary Examiner*—Marvin L. Nussbaum

*Attorney, Agent, or Firm*—C. L. Anderson; W. J. Benman, Jr.; A. W. Karambelas

[57] ABSTRACT

The present invention provides an improved microwave integrated circuit filter for electromagnetic waves. The filter includes a waveguide and three, four or more resonators spaced from one another and extending from the waveguide. Means, which may include a conductive ribbon, are provided electromagnetically coupling nonadjacent resonators.

4 Claims, 2 Drawing Figures

MICROWAVE INTEGRATED CIRCUIT, BANDPASS FILTER

BACKGROUND OF THE INVENTION

The present invention relates to filters and, more particularly, to a microwave integrated circuit including a bandpass filter.

In microwave communications, microwave integrated circuit (MIC) filters are used to select utilized frequencies and to reject unwanted frequencies which can result in noise. One design goal of such filters is to obtain sharp out-of-band rejection.

One commonly employed microwave wave circuit (MIC) bandpass filter is the combline filter. This filter includes a longitudinally extending transmission line section and plural, usually four, spaced resonators extending from and orthogonal to the transmission line. The four resonator combline filter represents an useful compromise between economy and effectiveness. More effective filtering can be achieved using more than four resonators, but the added cost and complexity of manufacture tend to outweigh the gain in effectiveness. Furthermore, the added bulk of the larger filters is a significant disadvantage in space and other applications where size and weight are at a premium. What is needed is a compact and economical filter which provides greater filtering effectiveness than the available four-section filter.

SUMMARY OF THE INVENTION

The present invention provides an improved filter for electromagnetic waves. The filter includes a transmission line andl plural resonators spaced from one another and extending from the transmission line. Means are provided electromagnetically coupling nonadjacent resonators.

In a more particular aspect of the present invention, the performance of a standard four-section combline filter in a microwave integrated circuit is enhanced by providing means for coupling the first and fourth resonators. The coupling means may be a gold ribbon, or a ribbon of other conductive material, or an alternative structure. The coupling means may be capacitively coupled to one resonator and inductively coupled to the other. For different applications, both couplings may be inductive, or both may be capacitive.

DETAILED DESCRIPTION OF THE INVENTION

Figure 1:
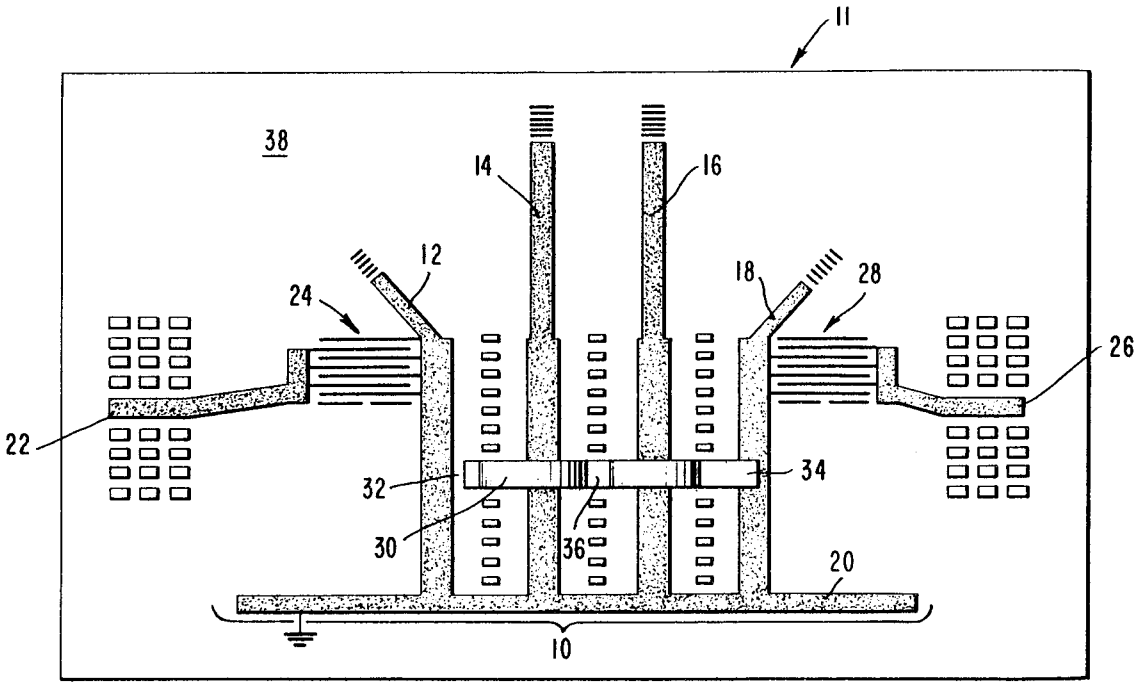
FIG. 1 is a bandpass filter in accordance with the present invention.

A filter 10 in accordance with the present invention includes a multitude of spaced resonators 12, 14, 16 and 18, as shown in FIG. 1. The resonators extend from a common transmission line 20. The comblike structure results in the common appellation "combline" filter. The filter 10 is coupled to an input line 22 by an input coupling means 24 and to an output line 26 by an output coupling means 28. In accordance with the present invention, a conductive ribbon 30 or other means couples nonadjacent resonators 12 and 18.

Describing the illustrated embodiment in greater detail, a microwave integrated circuit 11 includes a substrate 38, preferably of alumina, and a four-section combline filter 10. The filter 10 has a transmission line 20 and four spaced resonators 12, 14, 16 and 18. The resonators are spaced and extend generally orthogonally from the transmission line 20. The transmission line 20 is terminated to ground. A first resonator 12 is coupled to the input transmission line 22 by interdigitized input coupling means 24. A last resonator 18 is coupled to an output transmission line 26 by interdigitized output coupling means 28.

A gold ribbon 30 extends from adjacent the first resonator 12 to adjacent the last resonator 18. The coupling at 32 between the ribbon 30 and the first resonator 12 is capacitive, as indicated by the spacing between the ribbon 30 and the resonator. The coupling at 34 between the ribbon 30 and the last resonator is inductive. This coupling maintains a desired phase differential between the first resonator 12 and the last resonator 18. The ribbon 30 is physically, but not electromagnetically, attached to the substrate at 36 to provide a more secure structure.

Figure 2:
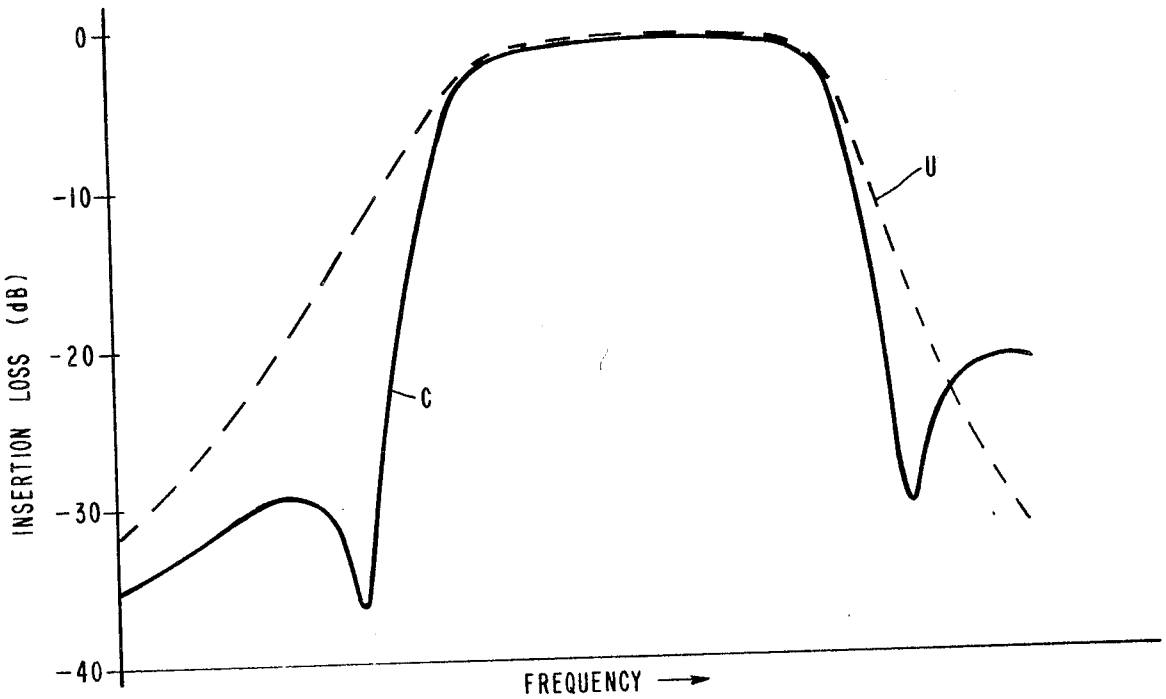
FIG. 2 is a graph depicting the comparative performances of a coupled filter in accordance with the present invention with an uncoupled filter in accordance with the prior art.

The effect on performance resulting from the coupling is indicated in FIG. 2. The typical performance of the uncoupled four-section combline filter 10 is indicated by curve U. The performance of the illustrated coupled four-section combline filter 10 in accordance with the present invention is depicted by curve C. Curve U may be characterized as Chebyshev, whereas the curve U may be characterized as elliptic. The elliptic curve C provides a substantially sharper out-of-band rejection in that its cutoff slopes are much steeper than those of the Chebyshev curve U.

Thus, the present invention provides an improved filter 10 with little additional bulk, cost or manufacturing complexity. The illustrated device does not require redesigning of the couplings to its environment.

Many modifications may be made on the illustrated embodiment within the scope of the present invention. Different materials and resonator arrangements can be considered, including combline filters with more than four elements. The ribbon couplings can be inverted. Furthermore, capacitive or inductive equalization can be achieved, where desired, by making both ribbon couplings capacitive or inductive, respectively. Other response patterns may be achieved by varying the two ribbon couplings.

What is claimed is:

1. A microwave integrated circuit filter for electromagnetic signals comprising:

a transmission line extending longitudinally;

at least three resonators arranged serially along said transmission line; and coupling means for electromagnetically coupling two nonadjacent of said resonators, said coupling means comprising a conductive ribbon which is inductively coupled to one of said resonators and is capacitively coupled to another of said resonators.

2. A microwave integrated circuit filter for electromagnetic signals comprising:

a transmission line extending longitudinally;

at least three resonators arranged serially along said transmission line; and coupling means for electromagnetically coupling two nonadjacent of said resonators, said coupling means comprising a conductive ribbon which is inductively coupled to one of said resonators and is inductively coupled to another of said resonators.

3. A microwave integrated circuit filter for electromagnetic signals comprising:

a transmission line extending longitudinally; p1 first, second, third and fourth resonators arranged serially along said transmission line and extending therefrom, said resonators being spaced from one another; and coupling means for electromagnetically coupling said first and fourth resonators, said coupling means comprising a conductive ribbon which is inductively coupled to one of said resonators and is capacitively coupled to another of said resonators.

4. A microwave integrated circuit filter for electromagnetic signals comprising:

a transmission line extending longitudinally;

first, second, third and fourth resonators arranged serially along said transmission line and extending therefrom, said resonators being spaced from one another; and coupling means for electromagnetically coupling said first and fourth resonators, said coupling means comprising a conductive ribbon which is inductively coupled to one of said resonators and is inductively coupled to another of said resonators.

* * * * *